United States Patent [19]

Ortloff

[11] Patent Number: 4,532,879

[45] Date of Patent: Aug. 6, 1985

[54] COMBINATION MOORING SYSTEM

[75] Inventor: John E. Ortloff, Houston, Tex.

[73] Assignee: Exxon Production Research Co., Houston, Tex.

[21] Appl. No.: 594,086

[22] Filed: Jun. 4, 1984

[51] Int. Cl.[3] ..... B63B 21/00

[52] U.S. Cl. ..... 114/230; 441/5

[58] Field of Search ..... 114/230, 250; 441/3–5; 141/387, 388; 188/265, 312

[56] References Cited

U.S. PATENT DOCUMENTS

| | | | |
|---|---|---|---|
| 2,979,014 | 4/1961 | Yordi | 114/230 |
| 3,060,885 | 10/1962 | Nolf | 114/230 |
| 3,353,512 | 11/1967 | Mathews et al. | 114/250 |
| 3,426,719 | 2/1969 | Mizell | 114/230 |
| 4,066,030 | 1/1978 | Milone | 114/250 |
| 4,144,831 | 3/1979 | Heydolph | 114/230 |
| 4,494,475 | 1/1985 | Eriksen | 114/230 |

*Primary Examiner*—Jesus D. Sotelo

*Attorney, Agent, or Firm*—Alan J. Atkinson

[57] ABSTRACT

An improved mooring system for mooring a floating vessel to an offshore structure is disclosed. The mooring system includes a first mooring arm connected to the vessel which is in sliding engagement with a second mooring arm connected to the structure. The first mooring arm is initially at a mean position relative to the second mooring arm in the absence of loading forces induced by wind, waves, ice, or an ocean current acting on the vessel. As a loading force urges the vessel away from the structure to displace the first mooring arm from the mean position, a hydraulic pressure cylinder is compressed to furnish a restoring force which counteracts the loading force. As the loading force subsides, the hydraulic pressure cylinder urges the first mooring arm toward the mean position. In a preferred embodiment of the invention, a stop is attached to the first mooring arm to limit the excursion of the first mooring arm from the mean position. In other embodiments of the invention, a block and tackle combination can be used to vary the size and the stroke of the hydraulic pressure cylinder required to accommodate a particular loading force.

14 Claims, 4 Drawing Figures

COMBINATION MOORING SYSTEM

FIELD OF THE INVENTION

The present invention relates to an apparatus for mooring a floating vessel to a fixed structure. More particularly, the present invention relates to a mooring apparatus which is capable of mooring a vessel to a fixed structure as loading forces induced by wind, waves, floating ice, and ocean currents act against the vessel.

BACKGROUND OF THE INVENTION

In the offshore production of oil, gas, and other production fluids, floating vessels are frequently used to transport the production fluids to onshore consuming markets. The production fluids are produced from the deck of an offshore structure which is firmly anchored to the sea floor with pilings. To convey production fluids from a subsea well to the water surface, the offshore structure supports a fluid-carrying system called a riser. A flowline connected to the upper end of the riser conveys the production fluids to a storage tanker which may be temporarily or permanently moored to the offshore structure. The production fluids are offloaded from the storage tanker to shuttle tankers for transportation to an onshore market.

To moor a floating vessel in a water environment, a mooring system should be sufficiently flexible to accommodate movement of the vessel relative to the fixed offshore structure. As the moored vessel is acted upon by loading forces induced by wind, waves, ice, and ocean currents, the vessel will roll, pitch and heave. In addition, the vessel will yaw about its mooring point as the direction of the loading forces varies. If the mooring system is rigid, movement of the vessel due to loading forces could damage the mooring system. If the movement of the vessel is sufficiently great, the offshore structure could also be damaged.

To furnish a flexible mooring system in an open water environment, nylon hawsers are often used to moor a vessel to an offshore structure. Because nylon is an elastic material, nylon hawsers dampen the movement of the vessel which is caused by the loading forces. Although nylon hawsers are sufficiently strong to moor a storage vessel to an offshore structure in an open water environment, nylon hawsers cannot be used year-round in a cryogenic environment such as the Arctic. During the Arctic winter, nylon loses its resiliency and becomes brittle. This brittleness reduces the breaking strength of nylon and may lead to failure of a nylon hawser. The presence of moving pack ice containing ice ridges up to thirty feet in height also prevents nylon hawsers from being used during the Arctic winter. Nylon hawsers which are weakened by the cold are particularly susceptible to failure as the moving pack ice acts against the moored vessel.

To handle forces induced by moving pack ice, rigid mooring chains are typically used to moor a vessel to an offshore structure during the Arctic winter. However, rigid mooring chains are not suitable in an open water environment because they are not sufficiently elastic to accommodate movement of the storage vessel. As the vessel moves toward the structure, the mooring chains can become slack. As loading forces urge the vessel away from the structure, the vessel can gain sufficient momentum to impart a large impact force to the mooring chains and offshore structure when the vessel reaches the excursion length of the chains. In such event, the chains and structure may be damaged.

Although nylon hawsers can moor a vessel in an open water environment and rigid mooring chains can be substituted for the nylon hawsers during the winter months, valuable production time is lost when the fluid-carrying system is shut down to convert from nylon hawsers to the mooring chains. The lost production time may be particularly significant during the spring and fall seasons when the vessel may alternately be exposed to moving pack ice and to open water. Therefore, there is a need for a mooring system that can accommodate loading forces acting on a vessel due to wind, waves, ice, or ocean currents. Furthermore, there is a need for a mooring system that can be used in a water environment and in an ice-bound environment.

SUMMARY OF THE INVENTION

The present invention provides an apparatus for mooring a floating vessel acted upon by a loading force induced by wind, waves, ice or ocean currents. The apparatus includes a first mooring arm connected to the vessel and a second mooring arm connected to a base. The first mooring arm is in sliding engagement with the second mooring arm and is initially at a mean position relative to the second mooring arm. A hydraulic pressure means is connected between the first mooring arm and the second mooring arm. As a loading force acts upon the vessel to displace the vessel and the first mooring arm from the mean position, the hydraulic pressure means is compressed to furnish a restoring force which counteracts the loading force. As the loading force subsides, the hydraulic pressure means urges the first mooring means towards the mean position.

In an alternative embodiment of the invention, a first hydraulic pressure means can be located to furnish a restoring force as a loading force urges the vessel away from the base, and a second hydraulic pressure means can be located to furnish a restoring force as a loading force urges the vessel toward the base. In another embodiment of the invention, a cable means reeved about a traveling sheave attached to the first mooring arm and a stationary sheave connected to the second mooring arm can be utilized in combination with a hydraulic pressure means to counteract the loading force.

DESCRIPTION OF THE PREFERRED EMBODIMENTS

Figure 1:
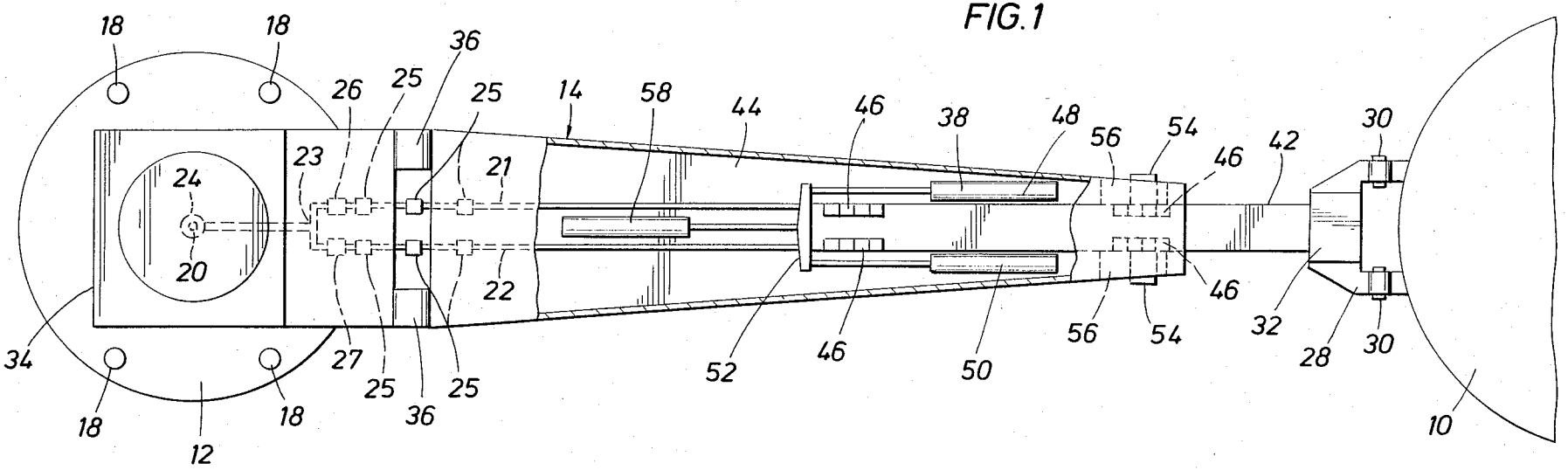
FIG. 1 illustrates in partial section an elevational view of a vessel connected to an offshore structure with a combination mooring system.

FIG. 1 illustrates vessel 10 which is connected to a base such as bottom founded offshore structure 12 by means of mooring system 14. Structure 12 is anchored to sea floor 16 with piles 18 which handle dynamic vertical and horizontal loading of structure 12 due to wave action or ice forces acting on structure 12. Static uplift of structure 12 is resisted by the weight of structure 12 and piles 18. Riser 20 is supported with structure 12 to convey production fluids from subsea wells (not shown) to the water surface. To convey the production fluids to vessel 10, flowlines 21 and 22 merge at tee 23 and are connected by axial swivel 24 to the upper end of riser 20. To accommodate relative movement between vessel 10 and riser 20, flowlines 21 and 22 can be articulated with concentric swivels 25. Valves 26 and 27 are respectively located in flowlines 21 and 22 to control the flow of the production fluids. Because flowlines 21 and 22 are controlled by separate valves, maintenance operations on either flowline can be performed without stopping the flow of the production fluids from riser 22.

In an open water environment, vessel 10 is subject to loading forces induced by wind, waves and ocean currents. These loading forces cause vessel 10 to pitch, heave, roll, and yaw about its mooring point. To accommodate pitch, heave and roll of vessel 10, mooring system 14 is connected by yoke 28 to vessel 10. The weight of mooring system 14 can be supported by a loading boom, counterbalance (not shown) or other technique well-known in the art. Yoke 28 includes hinges 30 which provide an articulated connection between mooring system 14 and vessel 10 to accommodate pitch and heave of vessel 10. Yoke 28 also includes roll shaft 32 to accommodate roll of vessel 10 about its longitudinal axis.

As the direction of the loading forces changes, vessel 10 will yaw about its mooring point and will tend to rotate about the vertical axis of structure 12. To accommodate such rotation, the upper end of structure 12 includes a turntable or mooring swivel 34 which rotates independently of structure 12. Mooring swivel 34, connected to mooring system 14, permits vessel 10 to weathervane about structure 12 as the direction of the loading forces change. Mooring system 14 may be connected to mooring swivel 34 by hinge 36 to permit rotation of mooring system 14 about a horizontal axis perpendicular to mooring system 14.

As vessel 10 weathervanes about structure 12, the loading forces will tend to urge vessel 10 away from structure 12. As previously discussed, neither nylon hawsers nor rigid mooring chains can adequately moor a vessel in an arctic environment which may include open water and moving pack ice. Moreover, neither nylon hawsers nor rigid mooring chains will prevent collision between the vessel and the mooring structure if the loading forces should change too suddenly for the vessel to weathervane about the structure. The present invention overcomes the shortcomings of nylon hawsers and rigid mooring chains by providing an apparatus which can moor a vessel in a changing arctic environment.

Figure 2:
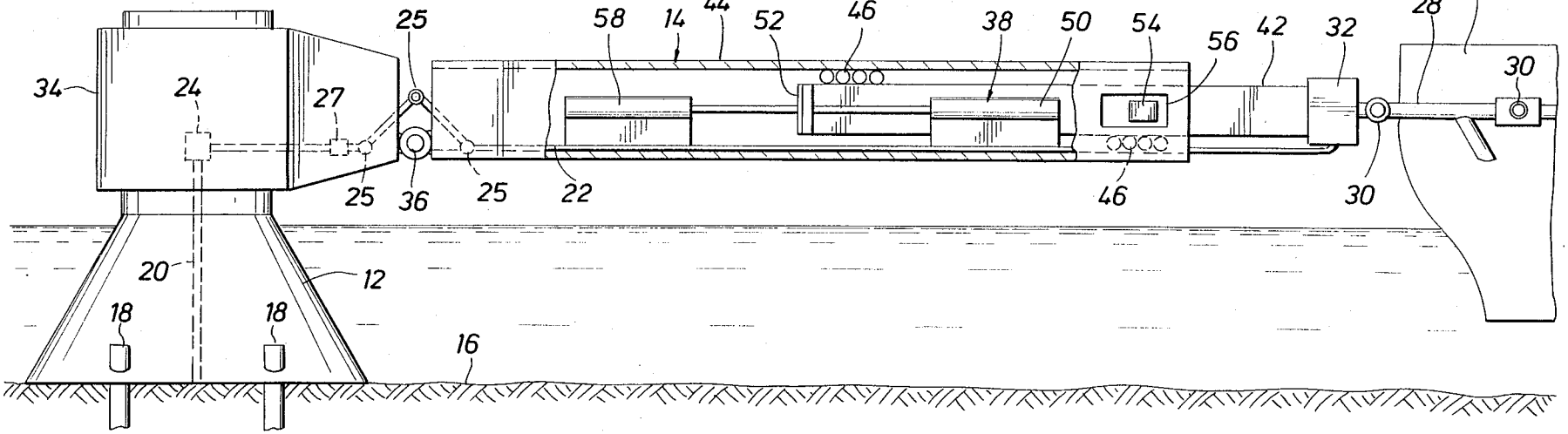
FIG. 2 illustrates in partial section a plan view of the mooring system.

To prevent the movement of vessel 10 from damaging structure 12 in a water environment, the present invention provides mooring system 14 which flexes to accommodate movement of vessel 10 relative to structure 12. Referring to FIG. 2, mooring system 14 generally includes restoring means 38, first mooring arm 42 and second mooring arm 44. One end of first mooring arm 42 is connected to yoke 28 with hinge 30, and one end of second mooring arm 44 is connected to mooring swivel 34 with hinge 36. The other, free end of first mooring arm 42 is in sliding engagement with the other, free end of second mooring arm 44 to accommodate relative movement between vessel 10 and structure 12. In a preferred embodiment, first mooring arm 42 is positioned to telescope within second mooring arm 44. To resist the horizontal and vertical loading forces imposed by first mooring arm 42 on second mooring arm 44, four wheel bogies 46 are mounted to first mooring arm 42 as illustrated in FIG. 1. The wheels on bogies 46, which are manufactured from a high grade cast carbon steel, have flatface treads and can be mounted with anti-friction bearings carried on stationary pins.

First mooring arm 42 is initially at a mean position relative to second mooring arm 44 when there are no loading forces acting on vessel 10. As loading forces urge vessel 10 away from structure 12, first mooring arm 42 is displaced from the mean position as it telescopes within second mooring arm 44 to accommodate movement of vessel 10. To urge first mooring arm 42 toward the mean position, restoring means 38 furnishes a restoring force on first mooring arm 42 which counteracts the loading forces acting on vessel 10.

Referring to FIG. 1, restoring means 38 comprises hydraulic pressure means 48 and 50, which are illustrated as single-action pneumatic cylinders having hydraulic lubrication. The contact surfaces between the piston rod and cylinder of each hydraulic pressure means is lubricated by the hydraulic lubricant contained within the cylinder. As is well-known in the art, hydraulic pressure means 48 and 50 each contain an accumulator which is filled with a gas such as nitrogen. Preferably, a hydraulic system (not shown) injects a phosphate-ester hydraulic lubricant into the cylinders of hydraulic pressure means 48 and 50. Thereafter, a pneumatic power pack (not shown) pressurizes the hydraulic lubricant to an initial pressure. A common crosshead 52, which is rigidly connected to first mooring arm 42, acts against the piston rod ends of hydraulic pressure means 48 and 50.

As loading forces urge vessel 10 away from structure 12 and first mooring arm 42 correspondingly telescopes outward from second mooring arm 44, crosshead 52 forces the piston rods of hydraulic pressure means 48 and 50 into each respective cylinder to pressurize the hydraulic fluid in the cylinders. As the hydraulic fluid is displaced by the piston, the hydraulic fluid will be forced into the accumulator to compress the gas. The pressure exerted by hydraulic pressure means 48 and 50 furnishes a restoring force which counteracts the loading forces acting on vessel 10. The configuration of hydraulic pressure means 48 and 50 can be varied to selectively dampen the force exerted by the loading forces. As the loading forces subside, hydraulic pressure means 48 and 50 will act against crosshead 52 to urge first mooring arm 42 toward the mean position.

Because the displacing force exerted by the loading forces acting on vessel 10 may exceed the pressure rating of hydraulic pressure means 48 and 50, first mooring arm 42 includes stop 54. Referring to FIG. 1, stop 54 travels within slot 56 in second mooring arm 44 as first mooring arm 42 telescopes within second mooring arm 44. When the loading force displaces vessel 10 away from structure 12 to a selected amount, stop 54 contacts the end of slot 56 which is furthest removed from structure 12 to transform mooring system 14 into a rigid mooring system. Because the mooring system becomes rigid, the system can accommodate extreme loading forces on vessel 10 such as those forces imposed by moving pack ice. When the loading forces are removed, as seasonally occurs during the spring breakup of pack ice, mooring system 14 automatically converts to a flexible system capable of handling movement of vessel 10 in an open water environment.

To prevent damage to vessel 10 or to structure 12 in the event that a sudden directional change in the loading forces should urge vessel 10 toward structure 12 before vessel 10 can weathervane about structure 12, hydraulic pressure means 58 is located between second mooring arm 44 and crosshead 52. If a loading force should urge vessel 10 toward structure 12, hydraulic pressure means 58 will act against the displacing force as previously described for hydraulic pressure means 48 and 50. To prevent damage to hydraulic pressure means 58, slot 56 has an end toward structure 12 for limiting the excursion of stop 54 and attached first mooring arm 42 toward structure 12. As the loading forces urge vessel 10 toward structure 12 and stop 54 contacts the inward end of slot 56, mooring system 14 becomes rigid to limit the excursion of first mooring arm 42 from the mean position and to prevent vessel 10 from riding up against structure 10. Therefore, mooring system 14 dampens the movement of vessel 10 toward structure 12 and prevents accidental contact therebetween.

As the loading forces subside or vessel 10 weathervanes about structure 12 to change the direction of the loading forces relative to the heading of vessel 10, hydraulic pressure means 58 will urge crosshead 52 and connected first mooring arm 42 toward the mean position. The location and initial pressure charge of hydraulic pressure means 48, 50, and 58 can be selected to vary the mean position of first mooring arm 42 relative to second mooring arm 44. Alternatively, a double action hydraulic pressure means could be utilized in place of hydraulic pressure means 48, 50, and 58 to counteract loading forces which urge vessel 10 toward or away from structure 12. The pressure in each hydraulic pressure means can be sensed by pressure transducers, and the stroke of each hydraulic pressure means can be sensed by displacement transducers. Signals from the transducers can be processed by remote computers and monitored by display panels (not shown).

Figure 3:
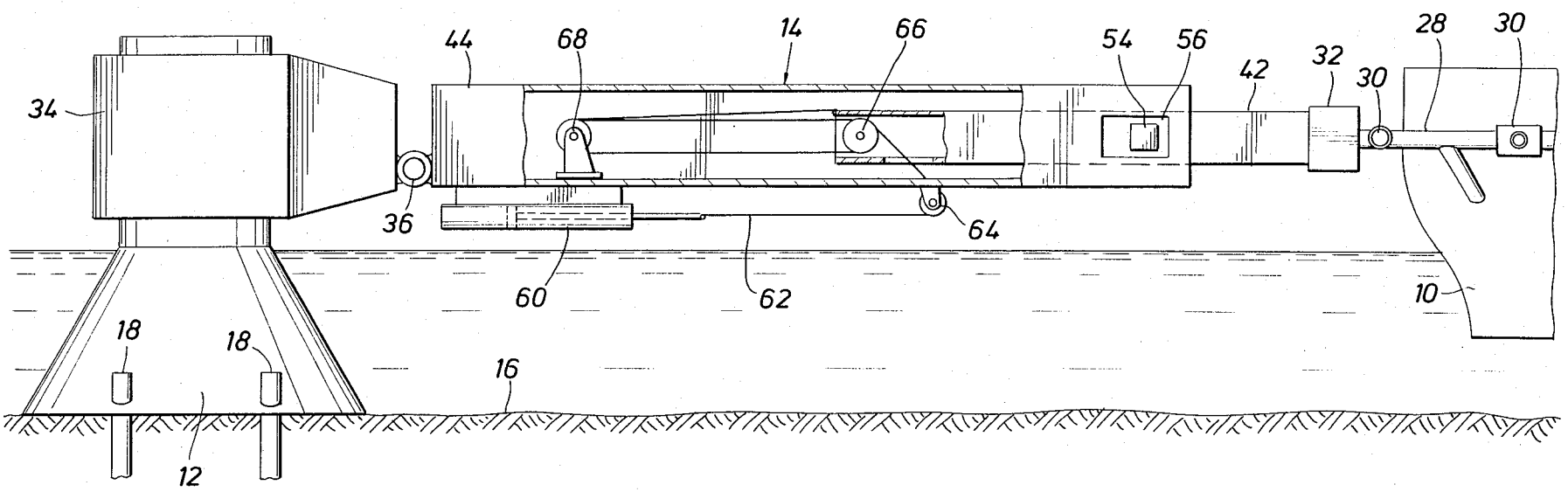
FIG. 3 illustrates in partial section an elevational view of an alternative embodiment of the invention wherein a cable and sheaves reduce the restoring force required of the hydraulic pressure means.

In alternative embodiments of the invention, various mechanical combinations using cables and sheaves can be used to vary the size and stroke of the appropriate hydraulic pressure means. Referring to FIG. 3, hydraulic pressure means 60 has one end connected to second mooring arm 44. Cable 62 is reeved about sheave 64 and traveling sheave 66 which are attached to first mooring arm 42 and is reeved about stationary sheave 68 which is attached to second mooring arm 44. One end of cable 62 is attached to hydraulic pressure means 60 and the other end of cable 62 is attached to first mooring arm 42. As a loading force urges vessel 10 away from structure 12, first mooring arm 42 will be moved away from the mean position and hydraulic pressure means 60 will be pressurized. As the loading force subsides, hydraulic pressure means 60 will urge first mooring arm 42 toward the mean position.

The size of hydraulic pressure means 60 and the number of active lines between traveling sheave 66 and stationary sheave 68 can be varied by one skilled in the art to fit a particular design criteria. For example, in a system having four active lines and a loading force of one million pounds, hydraulic pressure means 60 need only furnish 250,000 pounds load. The diameter or pressurization of the hydraulic pressure means 60 can be varied to accommodate the required load. Although the restoring force required of hydraulic pressure means 60 in this embodiment having four cable runs is one-fourth the load exerted by the displacing force, the piston travel required of hydraulic pressure means 60 will be four times the excursion of first mooring arm 42 from the mean position.

Figure 4:
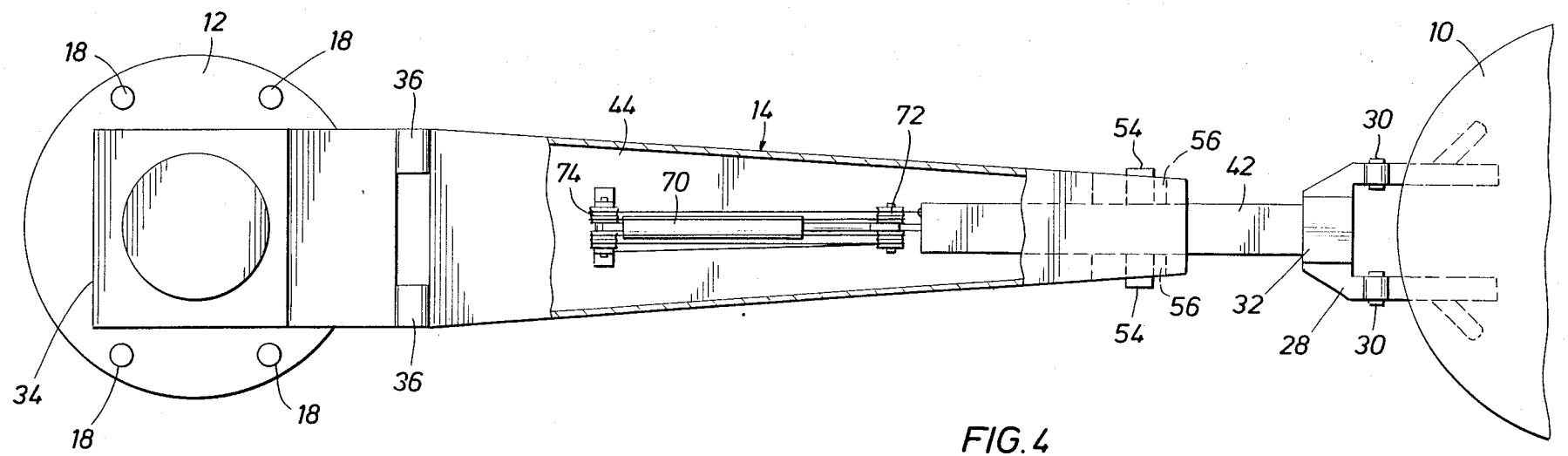
FIG. 4 illustrates in partial section an elevational view of an alternative embodiment of the invention wherein a cable and sheaves increase the required restoring force but reduce the required stroke of the hydraulic pressure means.

To reduce the length of piston travel required of hydraulic pressure means 60, FIG. 4 illustrates an alternative embodiment of the invention. Hydraulic pressure means 70 is illustrated as having one end attached to second mooring arm 44 and the other end attached to traveling sheave 72. Stationary sheave 74 is rigidly connected to second mooring arm 44. Cable 76 is reeved around traveling sheave 72 and stationary sheave 74. One end of cable 76 is attached to first mooring arm 42 and the other end is attached to second mooring arm 44.

Initially, first mooring arm 42 is at a mean position relative to second mooring arm 44. As loading forces urge vessel 10 away from structure 12, tension on cable 76 will pull traveling sheave 72 toward stationary sheave 74, thereby compressing hydraulic pressure means 70. As the loading force acting on vessel 10 subsides, hydraulic pressure means will urge traveling sheave 72 away from stationary sheave 74, thereby urging first mooring arm 42 toward the mean position.

As illustrated in FIG. 4, the piston travel of hydraulic pressure means 70 will be one-fourth the excursion of first mooring arm 42 from the mean position. To accommodate a one million pound loading force acting on vessel 10, and assuming that there are four active cable lines between sheaves 72 and 74, a hydraulic pressure means having a rating of 1000 psi should have a seventy-two inch diameter. If desired, multiple hydraulic cylinders of a lesser diameter could be combined to furnish the same restoring force. For example, two hydraulic pressure means having fifty-inch diameters or four hydraulic pressure means having thirty-six inch diameters could be substituted for a seventy-two inch diameter hydraulic pressure means.

Because the restoring force exerted by the hydraulic pressure means is a functional relationship between the volume and the pressure of the hydraulic fluid, the restoring force furnished by a hydraulic pressure means will continue to increase in response to an increase in the loading force. To prevent the pressure in each hydraulic pressure means from exceeding the pressure rating of the hydraulic pressure means, stop 54 on first mooring arm 42 and slot 56 can be configured to limit the excursion of first mooring arm 42 from the mean position. At that point, mooring system 14 becomes a rigid mooring system which is capable of accommodating extremely large loading forces.

The present invention furnishes a mooring system which is capable of mooring a floating vessel to a fixed structure. The mooring system is sufficiently flexible to accommodate movement of the vessel in an open water environment. Moreover, the mooring system can accommodate large loading forces such as those induced by moving ice.

What is claimed is:

1. An apparatus for mooring a floating vessel to a base, wherein the vessel is acted upon by a loading force induced by wind, waves, floating ice, or an ocean current, comprising:

a first mooring arm connected to the vessel;

a second mooring arm connected to said base such that said second mooring arm is in sliding engagement with said first mooring arm to permit movement between the vessel and the base, wherein said first mooring arm is initially at a mean position relative to said second mooring arm when the vessel is not acted upon by the loading force;

first hydraulic pressure means connected between said first mooring arm and said second mooring arm to furnish a restoring force, as the loading force urges the vessel away from the base to displace said first mooring arm from the mean position, for urging said first mooring arm toward the mean position; and second hydraulic pressure means connected between said first mooring arm and said second mooring arm to furnish a restoring force, as the loading force urges the vessel toward the base to displace said first mooring arm from the mean position, for urging said first mooring arm toward the mean position.

2. An apparatus as recited in claim 1, further comprising stop means for limiting the excursion of said first mooring arm from the mean position.

3. An apparatus as recited in claim 1, wherein said second mooring arm is rotatable about the base to permit weathervaning of the vessel about the base.

4. An apparatus for mooring a floating vessel to a base, wherein the vessel is acted upon by a loading force induced by wind, waves, floating ice, or an ocean current, comprising:

a first mooring arm connected to the vessel;

a second mooring arm connected to said base such that said second mooring arm is in sliding engagement with said first mooring arm to permit movement between the vessel and the base, wherein said first mooring arm is initially at a mean position relative to said second mooring arm when the vessel is not acted upon by the loading force;

first hydraulic pressure means connected between said first mooring arm and said second mooring arm to furnish a restoring force, as the loading force urges the vessel away from the base to displace said first mooring arm from the mean position, for urging said first mooring arm toward the mean position;

second hydraulic pressure means connected between said first mooring arm and said second mooring arm to furnish a restoring force, as the loading force urges the vessel toward the base to displace said first mooring arm from the mean position, for urging said first mooring arm toward the mean position; and stop means for limiting the excursion of said first mooring arm from the mean position.

5. An apparatus as recited in claim 4, wherein said second mooring arm is rotatable about the base to permit weathervaning of the vessel about the base.

6. An apparatus for mooring a floating vessel to a base, wherein the vessel is acted upon by a loading force induced by wind, waves, floating ice, or an ocean current, comprising:

a first mooring arm connected to the vessel;

a second mooring arm connected to said base such that said second mooring arm is in sliding engagement with said first mooring arm to permit movement between the vessel and the base, wherein said first mooring arm is initially at a mean position relative to said second mooring arm when the vessel is not acted upon by the loading force;

hydraulic pressure means connected to said second mooring arm;

cable means having one end attached to said hydraulic pressure means and having the other end attached to said first mooring arm, wherein displacement of said first mooring arm from the mean position due to the loading force acting on the vessel is transmitted by said cable means to actuate said hydraulic pressure means to furnish a restoring force for urging said first mooring arm toward the mean position.

7. An apparatus as recited in claim 6, further comprising first sheave means attached to said first mooring arm and second sheave means attached to said second mooring arm, wherein said cable means is reeved around said first sheave means and said second sheave means to reduce the magnitude of the loading force transmitted by said cable means to said hydraulic pressure means.

8. An apparatus as recited in claim 6, further comprising stop means for limiting the excursion of said first mooring arm from its initial position.

9. An apparatus as recited in claim 6, wherein said second mooring arm is rotatable about the base to permit weathervaning of the vessel about the base.

10. An apparatus for mooring a floating vessel to a base, wherein the vessel is acted upon by a loading force induced by wind, waves, floating ice, or an ocean current, comprising:

a first mooring arm connected to the vessel;

a second mooring arm connected to said base such that said second mooring arm is in sliding engagement with said first mooring arm to permit movement between the vessel and the base, wherein said first mooring arm is initially at a mean position relative to said second mooring arm when the vessel is not acted upon by the loading force;

hydraulic pressure means connected between said first mooring arm and said second mooring arm;

cable means having one end attached to said first mooring arm and having the other end attached to said second mooring arm, wherein displacement of said first mooring arm from the mean position due to the loading force acting on the vessel is transmitted by said cable means to actuate said hydraulic pressure means to furnish a restoring force for urging said first mooring arm toward the mean position; and a stop means for limiting the excursion of said first mooring arm from the initial position.

11. An apparatus as recited in claim 10, further comprising first sheave means attached to said first mooring arm and second sheave means attached to said second mooring arm, wherein said cable means is reeved around said first sheave means and second sheave means to reduce the magnitude of the loading force transmitted by said cable means to said hydraulic pressure means.

12. An apparatus as recited in claim 10, further comprising first sheave means attached to said first mooring arm and second sheave means attached to said second mooring arm, wherein said cable means is reeved around said first sheave means and second sheave means to increase the magnitude of the loading force transmitted by said cable means to said hydraulic pressure means.

13. An apparatus as recited in claim 10, wherein said second mooring arm is rotatable about the base to permit weathervaning of the vessel about the base.

14. An apparatus for mooring a floating vessel to a base, wherein the vessel is acted upon by a loading force induced by wind, waves, floating ice, or an ocean current, comprising:

a first mooring arm connected to the vessel;

a second mooring arm connected to said base such that said second mooring arm is in sliding engagement with said first mooring arm to permit movement between the vessel and the base, wherein said first mooring arm is initially at a mean position relative to said second mooring arm when the vessel is not acted upon by the loading force;

hydraulic pressure means connected to said second mooring arm; and cable means having one end attached to said hydraulic pressure means and having the other end attached to said first mooring arm, wherein displacement of said first mooring arm from the mean position is transmitted by said cable means to actuate said hydraulic means to furnish a restoring force for urging said first mooring arm toward the mean position.

* * * * *